US006599415B1

(12) United States Patent
Ku et al.

(10) Patent No.: US 6,599,415 B1
(45) Date of Patent: Jul. 29, 2003

(54) APPARATUS AND METHOD FOR ELECTROPOLISHING SURFACES

(75) Inventors: Yu-Chun Ku, Mountain View, CA (US); Ryan John Santos, San Jose, CA (US)

(73) Assignee: Advanced Cardiovascular Systems, Inc., Santa Clara, CA (US)

( * ) Notice: Subject to any disclaimer, the term of this patent is extended or adjusted under 35 U.S.C. 154(b) by 250 days.

(21) Appl. No.: 09/846,114

(22) Filed: Apr. 30, 2001

(51) Int. Cl.[7] ..... C25F 3/00; C25D 17/00; C25B 15/00

(52) U.S. Cl. ..... 205/670; 204/212; 204/237; 204/238; 204/239; 204/230.8; 204/224 M

(58) Field of Search ..... 204/239, 224 M, 204/238, 237, 212, 230.8; 205/670

(56) References Cited

U.S. PATENT DOCUMENTS

| | | | | |
|---|---|---|---|---|
| 2,741,594 A | * | 4/1956 | Bowersett | 204/212 |
| 3,556,883 A | | 1/1971 | Naito et al. | |
| 3,986,970 A | | 10/1976 | Shiga | |
| 4,082,638 A | * | 4/1978 | Jumer | 204/224 M |
| 4,330,381 A | * | 5/1982 | Jumer | 205/670 |
| 5,158,548 A | | 10/1992 | Lau et al. | |
| 5,186,796 A | * | 2/1993 | Kelly et al. | 204/224 M |
| 5,284,554 A | * | 2/1994 | Datta et al. | 205/653 |
| 5,344,425 A | | 9/1994 | Sawyer | |
| 5,421,955 A | | 6/1995 | Lau et al. | |
| 5,514,154 A | | 5/1996 | Lau et al. | |
| 5,567,300 A | * | 10/1996 | Datta et al. | 205/652 |
| 5,750,434 A | | 5/1998 | Urushidani et al. | |
| 6,019,784 A | | 2/2000 | Hines | |
| 6,131,266 A | | 10/2000 | Saunders | |
| 6,416,650 B1 | * | 7/2002 | Ho | 205/640 |

OTHER PUBLICATIONS

*Standard Guide for Electrolytic Polishing of Metallographic Specimens*, American Society and Materials (Designation: E 1558–93), pp. 1–12, 1993 (No Month).

*Standard Practice for Microetching Metals and Alloys*, American Society and Materials (Designation: E 407–93), pp. 1–18, 1993 (No Month).

*Standard Test Method for Macroetching Metals and Alloys*, American Society and Materials (Designation: E 340–93), pp. 1–10, 1993 No Month.

Surman, Hartmut et al., *Automatic Electropolishing of Cobalt Chromium Dental Cast Alloys With a Fuzzy Logic Controller, Computers Chemical Engineering*, vol. 22, No. 7–8, pp. 1099–1111, 1998 (No Month).

* cited by examiner

*Primary Examiner*—Donald R. Valentine
(74) *Attorney, Agent, or Firm*—Fulwider Patton Lee & Utecht, LLP

(57) ABSTRACT

A method and apparatus for electropolishing a workpiece without immersing the workpiece in a bath of electrolytic solution. The workpiece is held in an atmospheric environment, while electrolytic solution is discharged from a reservoir in the form of a plurality of jet streams onto the surface of the workpiece. A voltage difference is applied across the workpiece and the jet streams, thereby inducing a current to flow, between the workpiece acting as anode and the jet streams acting as cathode. The workpiece may be rotated about an axis and moved linearly along the same axis while the jet streams of electrolytic solution are discharged onto the workpiece. Anodic dissolution causes polishing of the workpiece surface. The electrolytic solution may be collected after discharge and recycled back into the reservoir, after being filtered and cooled.

25 Claims, 2 Drawing Sheets

FIG. 2
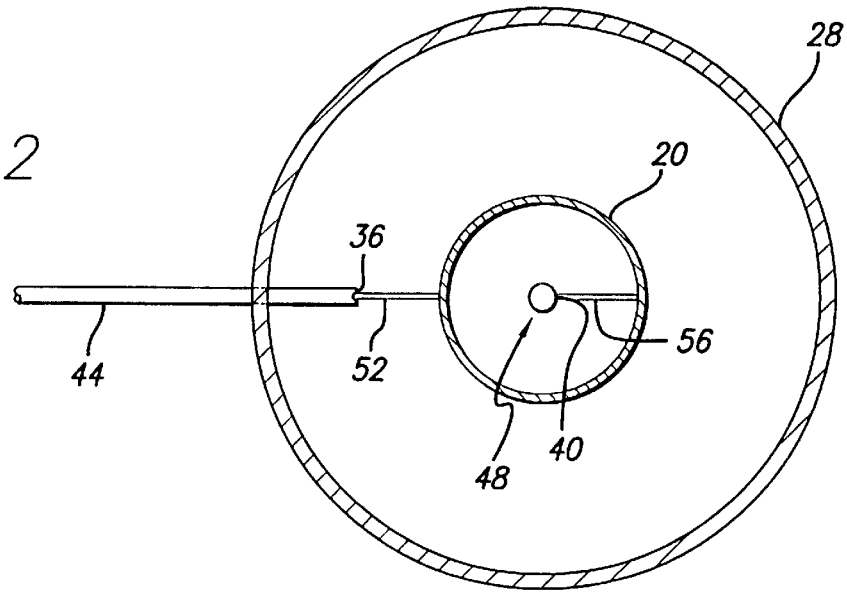
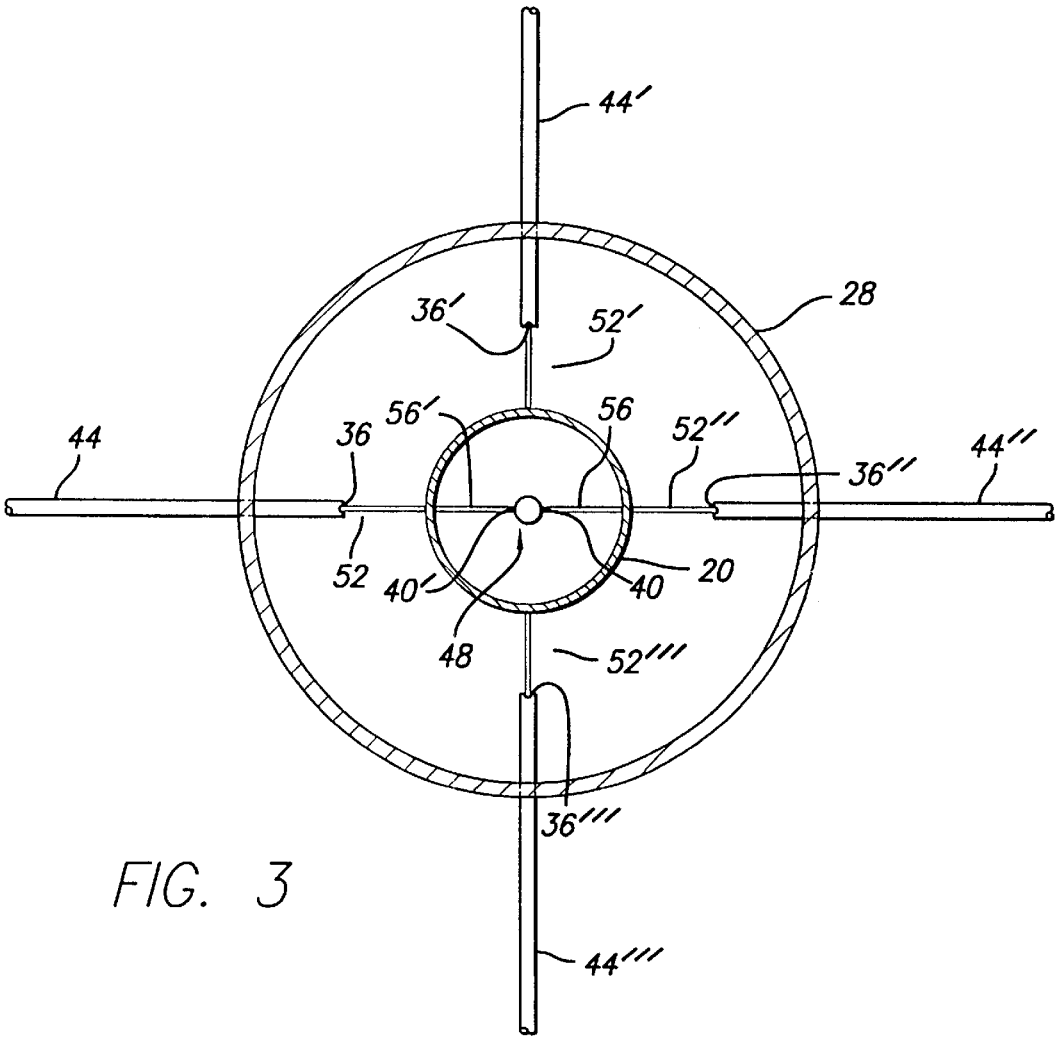
FIG. 3

APPARATUS AND METHOD FOR ELECTROPOLISHING SURFACES

BACKGROUND OF THE INVENTION

The present invention relates generally to an apparatus and method for electropolishing surfaces of metallic objects.

Electropolishing is a method used to obtain a clean and polished surface of a metallic object, and is described for example in McGraw-Hill Encyclopedia of Science & Technology, pp. 810–811, 1982, which is incorporated herein by reference. Typically, electropolishing is achieved by placing the object to be polished (the "workpiece") in a conductive vessel containing electrolytic solution. A voltage difference is then applied across the workpiece and the vessel, acting as anode and cathode respectively. The resulting current flow within the electrolyte between anode and cathode causes dissolution of the anodic surface and a corresponding deposit on the cathodic surface. Under certain parameters, which may include voltage, temperature, current density, and the composition and viscosity of electrolytic solution, the dissolution of the anode may produce a surface finish on the workpiece which is smooth and polished. Below a certain voltage level, etching may occur. Above the etching voltage level, a constant current region is reached where polishing may occur. At even higher voltage, oxygen evolution may interfere with polishing.

Once the correct voltage is established, various problems may still be encountered which tend to detract from the polish quality of the workpiece surface. One problem is that the current density may be unevenly distributed over the workpiece surface, resulting in an uneven surface finish. It is found that corners or edges with a small radius of curvature tend to attract and concentrate the flow of current in comparison with flat surfaces with a large radius of curvature. Thus, corners or edges of the workpiece may tend to become worn away, while flat surfaces may tend not to achieve the required degree of polish. Further, if the workpiece has a complex shape, current "shadows" may be cast by one element of the workpiece onto another, thus causing uneven polishing of a surface lying in such a shadow. Another problem is that heat is generated during the electropolishing process, and the temperature of the solution may rise during the process if a means for removing such heat is not provided. Generally, the rate and operating voltage of electropolishing are changed by the solution temperature, thereby reducing control over the process. A further problem is that as the process progresses, the opacity of the electrolytic solution may increase due to oxide flakes becoming suspended in the solution, thus impairing visual observation of the workpiece. Various techniques have been developed to reduce the impact of such problems. The anodic workpiece may be continuously rotated in the electrolytic solution, thus providing a more even current distribution across the surface of the workpiece, and reducing current shadows where they might exist. Further, the electrolytic solution may be continuously circulated by draining it from the vessel and pumping it back again, in order to cool it and filter out opaque particles while outside the vessel.

However, despite these techniques for overcoming problems found in the art of electropolishing, these techniques may not be fully effective in overcoming problems of uneven current flow associated with workpieces having an interior surface, such as a tube, because the interior surface may lie within a current shadow no matter how the workpiece is rotated.

Accordingly, there exists a need for an apparatus and method for electropolishing which is capable of overcoming the problem of current shadows which cannot be adequately addressed by rotating the workpiece in the electrolytic solution during the electropolishing process. The present invention addresses these and other needs.

SUMMARY OF THE INVENTION

Briefly, and in general terms, the present invention is directed to a new and improved apparatus and method for electropolishing the surface of an object. The apparatus includes a reservoir adapted to direct a steady jet stream of electrolytic solution onto a workpiece through an aperture. A voltage difference is applied across the workpiece and reservoir (as anode and cathode, respectively) while the electrolyte jet stream is directed onto the workpiece, to permit the flow of current through the electrolyte between anode and cathode.

In one embodiment of the invention, the reservoir may be rotated about the stationary workpiece while directing an electrolyte jet stream at the workpiece. In another embodiment, the workpiece may be rotated about an axis and may also be moved linearly on the same axis, while the reservoir remains stationary and directs the electrolyte jet stream at the workpiece. For a workpiece having both an inside and an outside surface, such as a tube, the reservoir may have nozzles or apertures directing electrolyte jet streams positioned both outside the workpiece, so as to direct jet streams at the outside surface, and also inside the workpiece, so as to direct jet streams directly at the interior surface. Desirably, the movement of the workpiece and the reservoir may be arranged to respond to forces controlled by computer or similar automated means, such that rotational and linear movement may be either simultaneous or independent of each other.

After the electrolytic solution has impacted the workpiece the solution may be collected, filtered, cooled if necessary, and then returned to the reservoir for further discharge, thus providing for continuous recycling of the electrolyte.

The apparatus and method of the present invention have the advantage of being able to focus a narrow jet stream of current-bearing electrolyte directly upon an anodic portion of the surface of a complex-shaped workpiece, without interference from current shadows which might be cast by other elements of such a workpiece were the workpiece to be immersed in a vessel of electrolytic solution. Moreover, as the workpiece is not immersed in solution, visibility of the workpiece is not impaired by opaque particles in suspension.

These and other objects and advantages of the invention will become apparent from the following more detailed description, when taken in conjunction with the accompanying drawings of illustrative embodiments.

BRIEF DESCRIPTION OF THE DRAWINGS

FIG. 2 is a plan sectional view of portion of the embodiment exemplified in FIG. 1 indicated by section lines 2—2.

FIG. 3 is a view of a variation of the embodiment shown in FIG. 2, exemplifying a plurality of electrolyte jet streams directed at the outside and inside surfaces of a tubular workpiece.

DETAILED DESCRIPTION OF THE PREFERRED EMBODIMENTS

Figure 1:
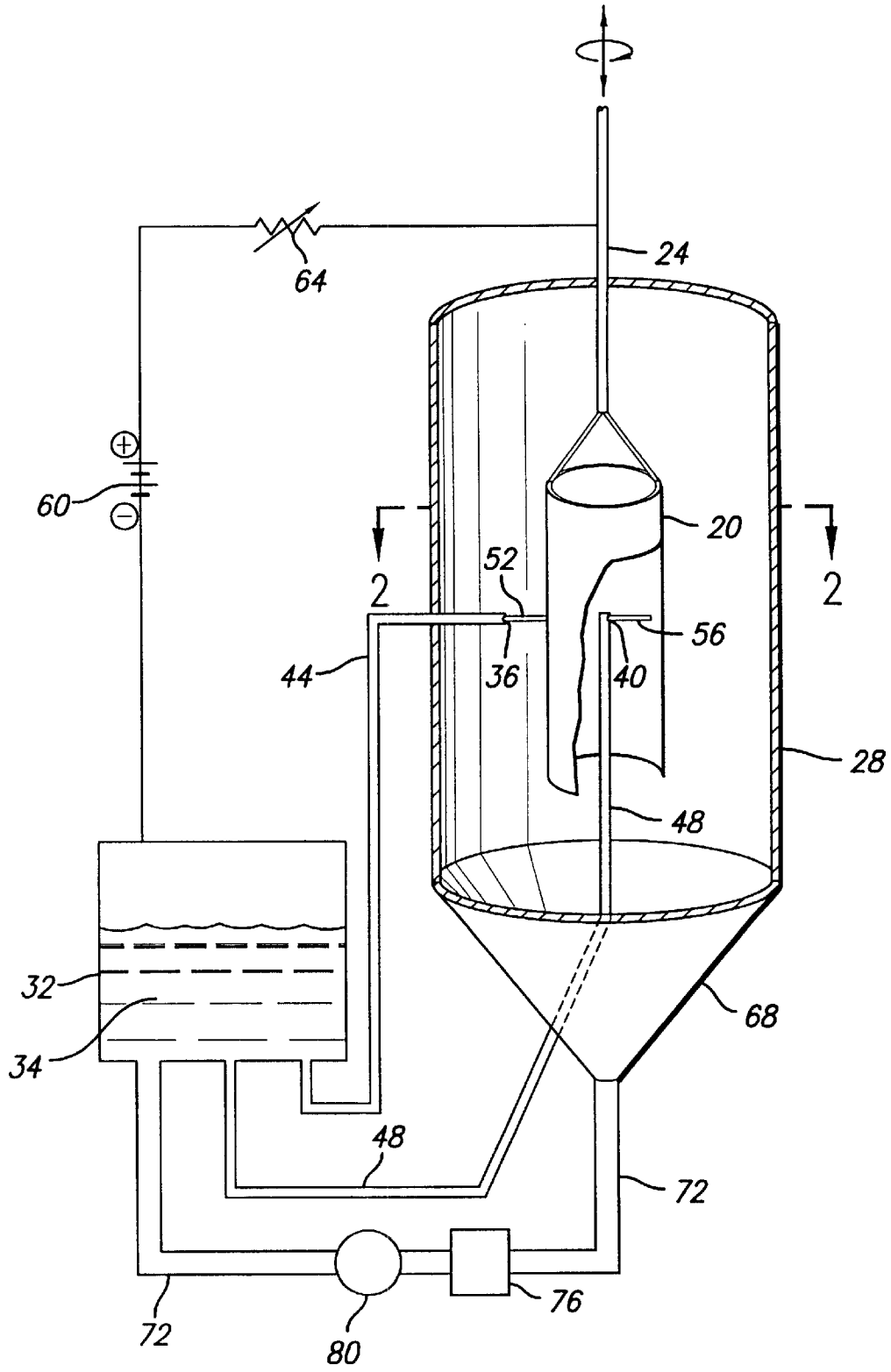
FIG. 1 is a schematic view of an embodiment of the present invention, depicting the spatial relationship between a tubular workpiece (shown in partial cutaway perspective) mounted on a turntable, with jet streams of electrolyte being directed at the outside and inside surfaces of the workpiece.

Referring now to the drawings, there are shown embodiments of the present invention, specifically, an apparatus and method for electropolishing an object by directing jet streams of electrolytic solution onto a workpiece while simultaneously causing electric current to flow in such jet streams.

With reference to FIGS. 1 and 2, there is shown one embodiment of the invention. A turntable 24 is provided, adapted to firmly support a workpiece 20 which, for purposes of demonstrating the present embodiment and method of the invention, is shown as being tubular. The invention is directed, however, to operate on a workpiece of any shape. The turntable is adapted to rotate on an axis, and to independently move linearly back and forth along the same axis while supporting the workpiece in atmosphere. Preferably, rotation and linear movement of the turntable is controlled by automated means, such as by computer controlled servo motor, and may be arranged to be simultaneous or independent. When the workpiece is held by the turntable, the contact between workpiece and turntable is adapted to be conductive, so that electric charge will easily flow across the contact.

An impermeable shield 28, desirably tubular, is provided to surround the space where the workpiece 20 is to be held by the turntable. A reservoir 32 adapted to contain an electrolytic solution 34 is provided and positioned in the vicinity of the shield. The appropriate choice of electrolytic solution will depend on the composition of the workpiece to be polished. Various electrolytic solutions which are suitable for use on various metal alloys are disclosed in the American Society for Testing and Materials (ASTM) publication E 1558-93, which is incorporated herein by reference. While some electrolytic solutions can be used at room temperature, others require heating before they can be used. Accordingly, the reservoir may be adapted to have a temperature-control mechanism capable of heating and maintaining the electrolyte at a temperature above room temperature. The reservoir may be further adapted to be conductive to the flow of electric charge, so that any charge applied to the reservoir will flow to the electrolytic solution. The interior of the reservoir is configured to be open to the atmosphere through a plurality of apertures 36, 40 which, as exemplified in FIGS. 1 and 2, may be situated remote from the reservoir body and connected thereto by means of conduits 44, 48. As used herein, the term "plurality" shall mean one or more. The reservoir is adapted to pressurize its electrolytic solution content, so that the same may be discharged as jet streams 52, 56 into the atmosphere from the apertures 36, 40 via conduits 44, 48. As exemplified in FIG. 1, the conduits may be arranged to pass through the wall of the shield as necessary so as to position the apertures 36, 40 in close proximity to where the workpiece is to be held by the turntable, and to discharge the jet streams 52, 56 directly onto the supported workpiece across an air gap.

A voltaic cell 60 may be provided and may be connected across the turntable 24 and the reservoir 32, as exemplified in FIG. 1, with the turntable acting as anode and the reservoir as cathode. Accordingly, when electrolytic solution 34 is discharged under pressure from the reservoir via the apertures 36, 40 as at least one jet streams 52, 56 impacting upon the surface of the metal workpiece 20, an electric circuit is closed, allowing electric charge to flow from the cell, via the turntable, thence via the workpiece, thence via the jet streams 52, 56 into the electrolytic solution within conduits 44, 48, thence via the reservoir back to the voltaic cell. It has been found that such closure of the electric circuit allows dissolution of the anodic workpiece in the electrolytic solution, and gives rise to electropolishing of the workpiece surface. However, the turntable should be formed of a material, such as titanium, which will not appreciably dissolve should electrolytic solution flow across its surface. In an alternative embodiment, the electric circuit may be configured with a cathode placed directly in the electrolytic solution within the reservoir, permitting charge to flow from the solution in the reservoir through the cathode to the voltaic cell. In yet a further embodiment, small cathodes, such as may be made from platinum wire, may be positioned directly within the jet streams of electrolytic solution, thus permitting charge to flow from the jet stream to the voltaic cell without passing through the electrolytic solution in the reservoir. It will be appreciated that each of the foregoing embodiments will result in current flowing between the workpiece, acting as anode, and the jet stream. Additionally, the voltage difference across the workpiece and jet stream may be achieved by using a voltaic cell, as set forth above, or by any other equivalent means such as by applying a positive charge to the workpiece and providing a lesser charge to the jet stream such as by grounding. Accordingly, as used herein, the term "circuit" may refer to a closed circuit which may include a voltaic cell, or an electric current path between a source of electric charge and a source of lesser charge.

During current flow in the electric circuit, it may be found that heating of the electrolytic solution, deposit on the cathode, or other factors, may cause the resistance of the circuit to increase and the current in the circuit to be thereby reduced. Accordingly, in series with the voltaic cell 60, a rheostat 64 of known design may be connected in the electric circuit described, as exemplified in FIG. 1, capable of automatically varying the current in the circuit to maintain the current at a substantially constant level. The same result may suitably be achieved by using, in place of the cell and the rheostat, a constant current cell such the Kikusui™ regulated DC power supply Model PAK 20-18A, by the Kikusui Electronics Corporation, of Yokahama, Japan. Once electrolytic solution 34 is discharged from the reservoir 32 in the form of a plurality of jet streams 52, 56 to impact the workpiece 20, the solution falls, under the influence of gravity, and may be collected by a collector 68, preferably of conical shape, attached to the screen 28. After being collected, the electrolytic solution may be pumped via a tube 72 back to the reservoir 32. If it is found that the solution requires cleaning to remove undesirable suspended particles caused by dissolution of the anodic workpiece, the solution may be cleaned by a filter 76 of known design positioned in the flowpath of the tube, as exemplified in FIG. 1. Further, if it is found that the solution has experienced undesirable heat gain, the same may be cooled by a heat extractor 80 of known design positioned in the flowpath of the tube. Certain types of electrolytic solution operate optimally at temperatures below room temperature, and when these solutions are used cooling may be required.

Referring to FIG. 3, there is exemplified how additional conduits and apertures may be configured in relation to the workpiece. For example, in addition to aperture 40, a further aperture 40' may be added to conduit 48 so that two jet streams 56, 56' are provided, directed radially outward onto the internal surface of the workpiece 20. It will be appreciated that more than two apertures could be provided on conduit 48, each to produce a jet stream, at the same or at different levels. Further, in addition to conduit 44 with its aperture 36, three more conduits, 44', 44", 44'" each with apertures 36', 36", 36'", may be connected to the reservoir 32 (not shown in FIG. 3) to penetrate the shield 28 and surround the workpiece 20, so as to produce jet streams 52, 52', 52", 52'" all directed radially inward onto the workpiece external surface. Such jet streams may be at the same or at different levels and need not be limited in number to four.

It will be appreciated that, according to the present invention, by suspending the workpiece in the atmosphere and by directing pressurized jet streams of electrolytic solution to impact the workpiece, problems of current shadow on interior surfaces, as described herein to be associated with an electrolytic solution bath, may be eliminated or reduced.

It has been found that the foregoing apparatus and method are highly suitable for electropolishing stents. Stents are small expandable metallic tubes with holes of various shapes formed in the tube wall, and are inserted into diseased or injured body cavities such as blood vessels, whereupon they are expanded to reinforce the tissue forming the cavity.

When the previously described apparatus and method are used to electropolish a stent, the following parameters may be preferable. The apertures 36, 40 may be configured to produce jet streams 52, 56 which cover a gap between apertures and workpiece 20 in the range of between about 5 millimeters and about 20 millimeters, preferably about 10 millimeters. The apertures may be further configured to produce jet streams having a diameter of between about 0.2 millimeters and about 2 millimeters. The pressure in the reservoir may be established to produce jet streams having a constant flow velocity of between about 1 meter per second and about 6 meters per second, preferably about 3 meters per second. The cell 60 and rheostat 64 in the circuit may be adapted to produce a constant current in the circuit of between about 1 amp and about 10 amps, preferably about 4 amps. The turntable 24 may be adapted to rotate at a rate producing a speed at the outside surface of the stent of between about 25 millimeters and about 125 millimeter per minute, preferably about 75 millimeters per minute. The turnable may be further adapted to move linearly along its axis at a speed if between about 125 millimeters per minute, preferably about 75 millimeters per minute. The rotation of the turntable may be either simultaneous with the linear movements, or independent thereof.

It will be apparent from the foregoing that, while particular forms of the invention have been illustrated and described, various modifications can be made without departing from the spirit and scope of the invention. For example, the settings of the apparatus and method for use with a stent may be used for any workpiece. Accordingly, it is not intended that the invention be limited, except as by the appended claims.

We claim:

1. A method for electropolishing a workpiece surface, comprising:

providing a reservoir containing electrolytic solution;

discharging the electrolytic solution from the reservoir in the form of at least one jet stream;

configuring the jet streams to have a diameter within a range of between about 0.2 millimeters and about 2 millimeters;

directing the at least one jet stream to impact the surface of the workpiece; and applying a voltage difference between the workpiece and the at least one jet stream, the workpiece acting as anode, whereby an electric current flows between the workpiece and the at least one jet stream.

2. The method of claim 1, wherein the electrolytic solution discharged from the reservoir is collected and recycled into the reservoir.

3. The method of claim 2, wherein the electrolytic solution is filtered after collecting.

4. The method of claim 2, wherein the electrolytic solution is cooled after collecting.

5. The method of claim 1, wherein the voltage difference is varied to maintain a substantially constant electric current flowing between the workpiece and the at least one jet stream.

6. The method of claim 5, wherein the current flowing between the workpiece and the at least one jet stream is maintained within a range of about 1 amp and about 10 amps.

7. The method of claim 1, wherein the jet streams are configured to have a diameter within a range of between about 0.2 millimeters and about 2 millimeters.

8. The method of claim 1, wherein the workpiece is rotated about an axis.

9. The method of claim 8, wherein the workpiece is rotated at a rate to produce a speed at the outer surface of the workpiece within a range of between about 25 millimeters and about 125 millimeters per minute.

10. The method of claim 1, wherein the workpiece is moved linearly along an axis.

11. The method of claim 10, wherein the workpiece is moved at a speed within a range of about 25 millimeters and about 125 millimeters per minute.

12. The method of claim 1, wherein at least some of the at least one jet streams are directed at an inside surface of the workpiece.

13. A method for electropolishing a workpiece surface, comprising:

providing a reservoir containing electrolytic solution;

discharging the electrolytic solution from the reservoir in the form of at least one jet stream;

adapting the jet streams to have a flow velocity in the range of between about 1 meter per second and about 6 meters per second;

directing the at least one jet stream to impact the surface of the workpiece; and applying a voltage difference between the workpiece and the at least one jet stream, the workpiece acting as anode, whereby an electric current flows between the workpiece and the at least one jet stream.

14. A method for electropolishing a workpiece surface, comprising:

providing a reservoir containing electrolytic solution;

discharging the electrolytic solution from the reservoir in the form of at least one jet stream;

adapting the jet streams to have a length in a range of between about 5 millimeters and about 20 millimeters;

directing the at least one jet stream to impact the surface of the workpiece; and applying a voltage difference between the workpiece and the at least one jet stream, the workpiece acting as anode, whereby an electric current flows between the workpiece and the at least one jet stream.

15. An apparatus for electropolishing a workpiece, comprising:

a turntable adapted to support the workpiece in atmosphere;

a reservoir having at least one aperture and adapted to contain a volume of electrolytic solution, the reservoir being further adapted to discharge the solution under pressure from the at least one aperture in the form of at least one jet stream directed to impact the workpiece, the at least one jet stream having a diameter within a range of between about 0.2 millimeters and about 2 millimeters; and a source of electric charge connected to the turntable to form a conductive circuit producing current flowing between the workpiece acting as anode and the at least one jet stream when the at least one jet stream is discharged to impact the workpiece.

16. The apparatus of claim 15, wherein the source of electric charge is a voltaic cell.

17. The apparatus of claim 15, further comprising a receptacle connected to the reservoir by a tube, the receptacle being adapted to collect electrolytic solution discharged from the reservoir and to recycle the electrolytic solution to the reservoir through the tube.

18. The apparatus of claim 17, further comprising a filter positioned in the tube flowpath between the receptacle and the reservoir, adapted to filter particles from the electrolytic solution.

19. The apparatus of claim 15, further comprising a rheostat serially connected in the conductive circuit, adapted to automatically maintain a constant current flowing in the conductive circuit when the circuit is closed.

20. The apparatus of claim 19, wherein the constant cell and rheostat are configured to maintain a constant current in the range of between about 1 amp and about 10 amps.

21. The apparatus of claim 15, wherein the turntable is adapted to rotate to produce a speed at the outer surface of the workpiece within a range of between about 25 millimeters and about 125 millimeters per minute.

22. The apparatus of claim 15, wherein the at least one aperture is configured to produce at least one jet stream having a diameter within a range of between about 0.2 millimeters and about 2 millimeters.

23. The apparatus of claim 15, wherein the workpiece has an interior surface, and wherein at least some of the at least one aperture are configured to direct a jet stream of electrolytic solution at the interior surface of the workpiece.

24. An apparatus for electropolishing a workpiece, comprising:

a turntable adapted to support the workpiece in atmosphere, wherein the turntable is adapted to move on a linear axis coaxial with its axis of rotation at a speed of between about 25 millimeters and about 125 millimeters per minute;

a reservoir having at least one aperture and adapted to contain a volume of electrolytic solution, the reservoir being further adapted to discharge the solution under pressure from the at least one aperture in the form of at least one jet stream directed to impact the workpiece; and a source of electric charge connected to the turntable to form a conductive circuit producing current flowing between the workpiece acting as anode and the at least one jet stream when the at least one jet stream is discharged to impact the workpiece.

25. The apparatus of claim 24, wherein the turntable is adapted to move on a linear axis at a speed of between about 25 millimeters and about 125 millimeters per minute.

* * * * *